US005660088A

United States Patent [19]

Benson

[11] Patent Number: 5,660,088

[45] Date of Patent: Aug. 26, 1997

[54] ADJUSTABLE SOCKET WRENCH WITH LOCKING ARM

[76] Inventor: Todd W. Benson, 909 13th St. No. 24, Golden, Colo. 80401

[21] Appl. No.: 597,396

[22] Filed: Feb. 8, 1996

[51] Int. Cl.[6] ..... B25B 13/18

[52] U.S. Cl. ..... 81/128; 81/173; 279/69

[58] Field of Search ..... 81/128, 129, 155, 81/157, 173; 279/55, 56, 66, 69

[56] References Cited

U.S. PATENT DOCUMENTS 4,884,480 12/1989 Briese ..... 81/128

4,911,040 3/1990 Km ..... 81/128

*Primary Examiner*—James G. Smith

*Attorney, Agent, or Firm*—Edwin H. Crabtree; Donald W. Margolis; Ramon L. Pizarro

[57] ABSTRACT

An adjustable socket wrench with bolt head locking arm for engaging, removing and replacing different size bolts in a work piece. The socket wrench is designed to engage a bolt head at right angles and when locked on the bolt head holding the head with zero tolerance for ease in loosening and tightening the bolt. The wrench includes a wrench body with an upper end portion, a middle portion and a lower end portion. A channel is cut across the width of the upper end portion of the wrench body for receiving a first sliding jaw and a second sliding jaw. The bolt head is received between the first and second jaws. A first jaw guide arm is pivotally mounted on the wrench body with one end of the first jaw guide arm engaging the first jaw. A second jaw guide arm is pivotally mounted on the wrench body with one end of the second jaw guide arm engaging the second jaw. The first jaw guide arm is pivotally mounted to the bolt head locking arm. The bolt head locking arm in turn is pivotally mounted to a first pivot arm. The second jaw guide arm is pivotally mounted to a second pivot arm. The first and second pivot arms are engaged by a tightening nut threaded on the lower end portion of the wrench body. When the tightening nut is threaded upwardly on the wrench body, the first and second pivot arms move upwardly pivoting the first and second jaw guide arms inwardly. The first and second jaw guide arms move the first and second jaws toward each other for engaging a bolt head received therebetween.

16 Claims, 2 Drawing Sheets

ADJUSTABLE SOCKET WRENCH WITH LOCKING ARM

BACKGROUND OF THE INVENTION (a) Field of the Invention

This invention is related to hand tools such as socket wrenches and more particularly, but not by way of limitation, to a socket wrench which is adjustable for removing and replacing different sizes and shapes of bolts or as a stud remover on a work piece.

(b) Discussion of Prior Art

U.S. Pat. Nos. 1,760,338 to Billmyer, Jr., 1,600,645 to Smith and 1,107,769 to Earl et al. illustrate some old patents describing different types of adjustable socket wrenches. The Billmyer patent illustrates the uses of a threaded shank that moves link bars or rods outwardly for adjusting 6 fingers that grip the sides of different size bolt heads. The Smith patent also uses a threaded shank for adjusting a pair of jaws around different size nut and bolt heads. The Earl et al patent describes the use of split rings and pins for adjusting different size socket heads allowing you to select the correct socket head for the size of bolt to be removed.

Also, U.S. Pat. Nos. 5,386,749 to Kim, 4,528,875 to Hurst et al. and 4,809,570 to Jeng describe different types of adjustable socket wrenches. Further, U.S. Pat. No. 3,251,251 to Popper et al. and Russian Patent SU1,271,730 describe two different types of gripping tools for removing bolts.

None of the above mentioned patents specifically disclose or teach the unique structure and features of the subject adjustable socket wrench with bolt head locking arm for engaging, removing and replacing different size bolts.

SUMMARY OF THE INVENTION

In view of the foregoing, it is an object of the present invention to provide a single adjustable socket wrench for removing different sizes and shapes of bolts, thereby eliminating the need to have a number of different size socket wrenches when working on various size bolts in a work piece. The socket wrench is easy to use and can quickly be adjusted to grip different size bolt heads. Also the socket wrench can be used as a stud remover.

Another object of the invention is the subject adjustable socket wrench which when using the bolt head locking arm, holds and grips the bolt head with zero tolerance, eliminating any play between the bolt head and the gripping jaws of the socket wrench.

Still another object of the adjustable socket wrench is the wrench designed to engage the bolt head at right angles and securely grip worn and misshapen bolt heads which heretofore were difficult to remove.

The subject invention includes a wrench body with an upper end portion, a middle portion and a lower end portion. A channel is cut across the width of the upper end portion of the wrench body for receiving a first sliding jaw and a second sliding jaw. The bolt head is received between the first and second jaws. A first jaw guide arm is pivotally mounted on the wrench body with one end of the first jaw guide arm engaging the first jaw. A second jaw guide arm is pivotally mounted on the wrench body with one end of the second jaw guide arm engaging the second jaw. The first jaw guide arm is pivotally mounted to the bolt head locking arm. The bolt head locking arm in turn is pivotally mounted to a first pivot arm. The second jaw guide arm is pivotally mounted to a second pivot arm. The first and second pivot arms are engaged by a tightening nut threaded on the lower end portion of the wrench body. When the tightening nut is threaded upwardly on the wrench body, the first and second pivot arms move upwardly pivoting the first and second jaw guide arms inwardly. The first and second jaw guide arms move the first and second jaws toward each other for engaging a bolt head received therebetween.

These and other objects of the present invention will become apparent to those familiar with socket wrenches when reviewing the following detailed description, showing novel construction, combination, and elements as herein described, and more particularly defined by the appended claims, it being understood that changes in the precise embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments of the present invention according to the best modes presently devised for the practical application of the principles thereof, and in which.

DESCRIPTION OF THE PREFERRED EMBODIMENTS

Figure 1:
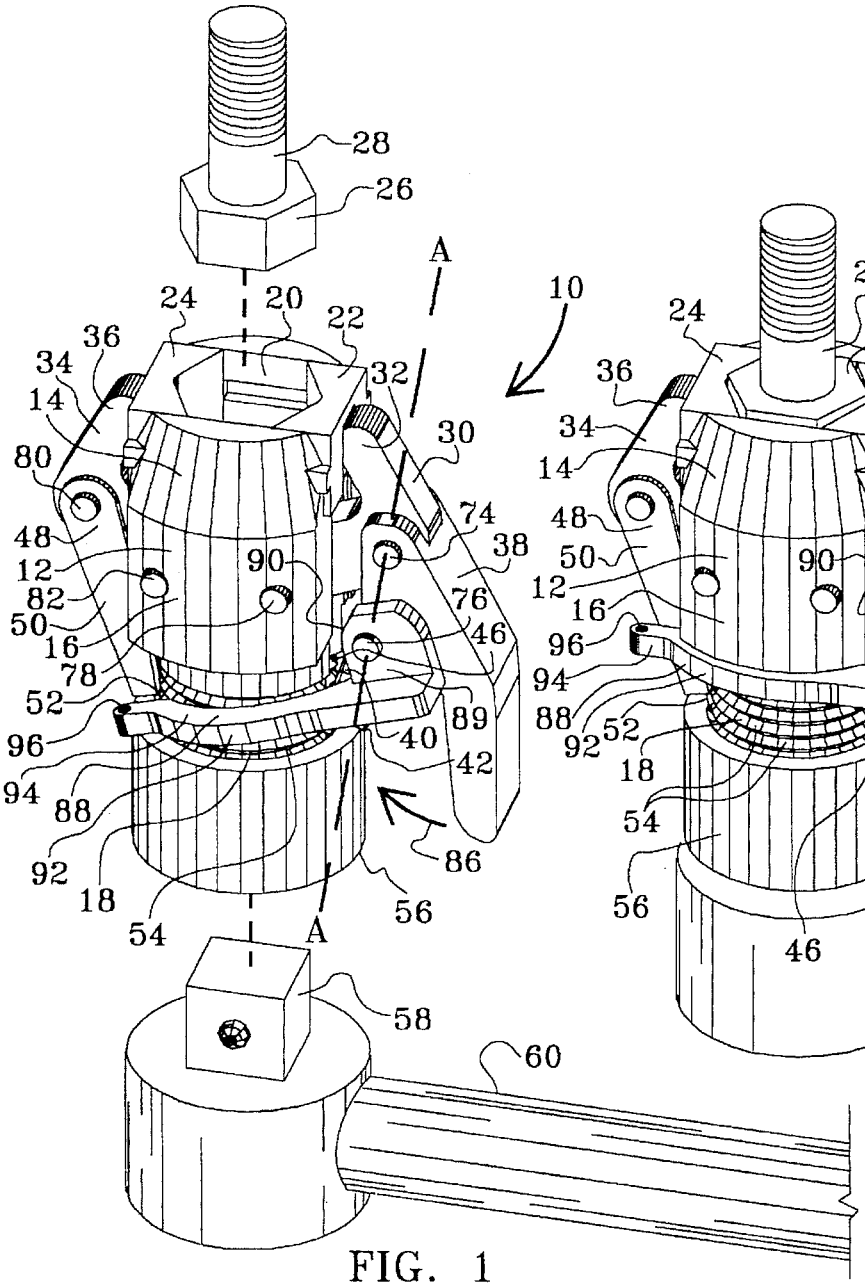
FIG. 1 is a perspective view of the subject adjustable socket wrench positioned for receiving a bolt head of a bolt at right angles and a ratchet handle positioned for engaging and turning the socket wrench. A bolt head locking arm is shown in an unlocked position.

In FIG. 1, the subject adjustable socket wrench is designated by general reference numeral 10. The wrench 10 includes a wrench body 12 with an upper end portion 14, a middle portion 16 and a lower end portion 18. A channel 20 is cut across the width of the top of the upper end portion for receiving a first sliding jaw 22 and a second sliding jaw 24. A bolt head 26 of a bolt 28 is shown in FIG. 1 positioned for receipt between the first and second jaws 22 and 24. A first jaw guide arm 30 is pivotally mounted on the wrench body 12 with one end 32 of the first jaw guide arm 30 engaging the first jaw 22. A second jaw guide arm 34 is pivotally mounted on the wrench body 12 with one end 36 engaging the second jaw 24.

A bolt head locking arm 38 is pivotally attached to the first jaw guide arm 30 and an upper end 40 of a first pivot arm 42. In FIG. 1, the bolt head locking arm is shown in an unlocked position. The first pivot arm 42 has a lower end 44 which is received in a first slide groove 46 disposed along a portion of the length of the lower end portion 18 of the wrench body 12. An upper end 48 of a second pivot arm 50 is pivotally attached to the second jaw guide arm 34. A lower end 52 is received in a second slide groove disposed along a portion of the length of the lower end portion 18 of the wrench body 12. The second slide groove is not shown in the drawings and is similar to the first slide groove 46. The lower end portion 18 of the wrench body 12 includes threads 54 for receiving a tightening nut 56 thereon. In the bottom of the lower end portion 18 of the wrench body 12 is an angular opening, not shown in the drawings, for receiving an angular ratchet lug 58. The ratchet lug 58 is releasably attached to the bottom of the wrench body 12, the ratchet handle 60 is used for loosening and tightening the bolt 28 engaged by the adjustable socket wrench 10.

Figure 1A:
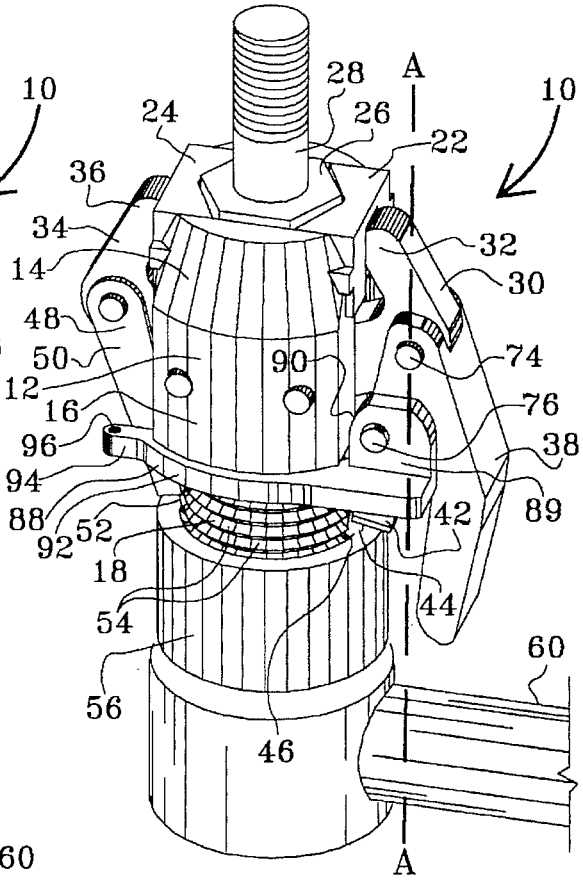
FIG. 1*a* is another perspective view of the subject adjustable socket wrench with locking jaws received around the sides of a hexagonal bolt head and the ratchet handle engaged with the socket wrench for loosening or tightening the bolt. Also, the bolt head locking arm is shown in a locked position.

In FIG. 1*a* another perspective view of the wrench 10 is shown with the first and second sliding jaws 22 and 24 engaging the sides of the hexagonal head 26 of bolt 28. While the bolt 28 is shown with hexagonal head 26, it can be appreciated by those skilled in the art that different angular bolt heads can be used with the subject adjustable socket wrench with the sliding jaws 22 and 24 adapted accordingly. In this drawing, the bolt head locking arm 38 has been moved into a locked position which in turn tightens the sliding jaws 22 and 24 against the head 26 leaving zero tolerance therebetween. Also, the ratchet lug 58 has been inserted into the opening in the bottom of the lower end portion 18 of the wrench body 12, and the wrench handle 60 can now be used for rotating the wrench 10 in either tightening or loosening the bolt 28 in a work piece.

Figure 2:
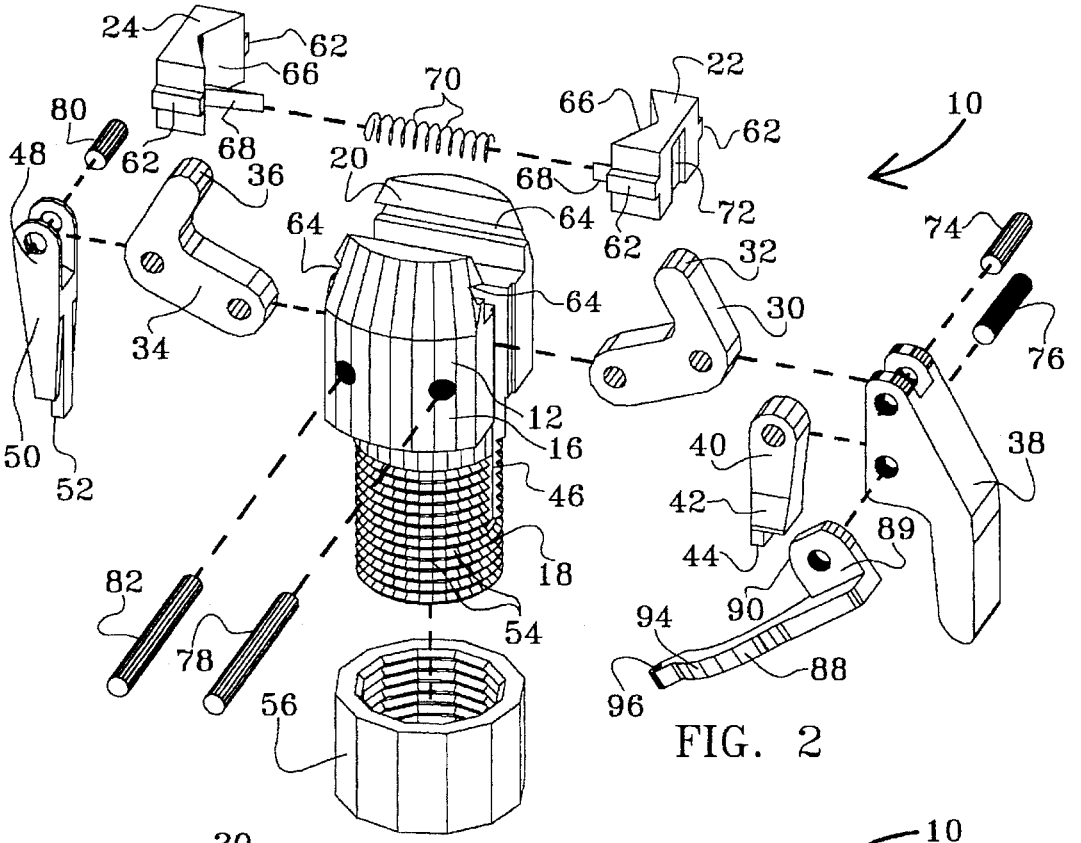
FIG. 2 is another perspective view of the socket wrench with the individual parts of the wrench shown in perspective views.
Figure 3:
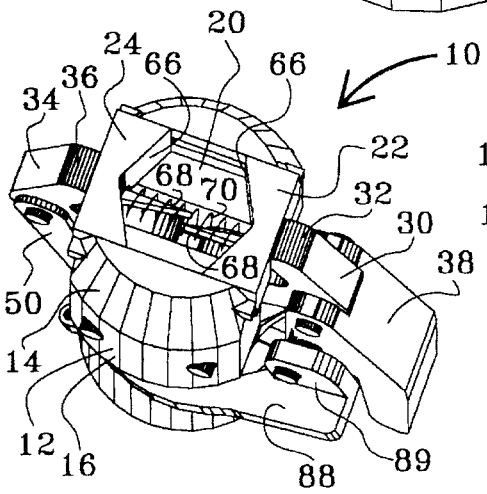
FIG. 3 is another perspective view of the socket wrench looking downwardly at the top of the wrench.

Referring now to both FIGS. 2 and 3, the first sliding jaw 2 and second sliding jaw 24 are shown with channel guides 62 on opposite sides of the jaws 22 and 24. The guides 62 are received in channels slots 64 on opposite sides of the channel 20. The guides 62 are used to keep the jaws 22 and 24 in proper alignment as they move toward and away from each other in the channel 20. A bolt head engaging face 66 of the jaws 22 and 24 is formed in a "V" shape for receiving adjacent sides of the bolt head 26. In this example, the bolt head 26 is hexagonal and the "V" shaped face 66 of the jaws 22 and 24 engage four of the sides of the bolt head 26. The jaws 22 and 24 also include outwardly extending spring guides 68 which are received inside a coil spring 70 disposed between the jaws 22 and 24 and positioned at the bottom of the channel 20. The back of the jaws 22 and 24 also include a notch 72 for receiving the one end 32 of the first jaw guide arm 30 and the one end 36 of the second jaw guide arm 34.

In FIG. 2, a first pin 74 is used for pivotally securing the first jaw guide arm 30 to the top of the bolt head locking arm 38. A second pin 76 is used for pivotally securing the bolt head locking arm 38 to the upper end 40 of the first pivot arm 42. A third pin 78 is used for pivotally securing the first jaw guide arm 30 to the wrench body 12. On the other side of the wrench body 12, a fourth pin 80 is used for pivotally securing the second jaw guide arm 34 to the second pivot arm 50. A fifth pin 82 is used for pivotally securing the second jaw guide arm 34 to the wrench body 12.

Figure 4:
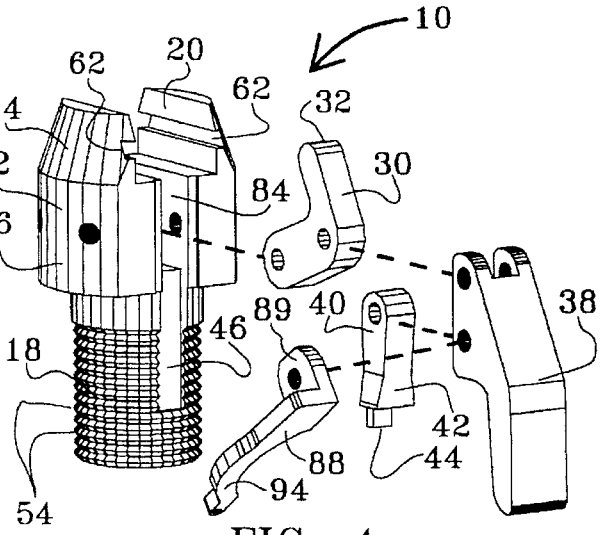
FIG. 4 is a perspective view of the socket wrench illustrating a side view of a channel cut across the width of the upper portion of a wrench body for receiving a first and second sliding jaw.

In FIG. 4 another perspective view of the wrench 10 is shown with the first and second sliding jaws 22 and 24 removed from the channel 20 to expose the channel guides 62. Also in this drawing an opening 84 in the middle portion 16 of the wrench body 12 is shown for receiving a portion of the first and second jaw guide arms 30 and 34 and receiving pins 78 and 82 therethrough. In this view the slide groove 46 can be seen running along the length of the lower end portion 18.

Referring back to the above mentioned drawings, to aid in releasing the bolt head locking arm 38 a bolt head release arm 88 is shown with a first end 89 pivotly mounted on second pin 76. The release arm 88 has a cam surface 90 for engaging a portion of the side of the wrench body 12. In FIG. 1 the release arm 88 is shown in an unlocked position. In FIG. 2 the release arm 88 is in a locked position with the cam surface 90 engaging the wrench body 12. When the wrench 10 is working in tight quarters and the locking arm 38 can not be release by hand, by pulling an elongated arm portion 92 of the release arm 88 downwardly the cam surface 90 rotates the locking arm 38 outwardly into an unlocked position as shown in FIG. 1 for releasing the wrench 10 from the bolt 28. Note a second end 94 of the elongated arm portion 92 includes a hole 96 therein for receiving a pull cord. The pull cord is not shown in the drawings. By using a pull cord with the release arm 88 the wrench 10 can be unlocked from the bolt 28 when using the wrench 10 on a work piece in close quarters and where it is impossible to engage the release arm 88 or the locking arm 38 by hand. The use of the release arm 88 with the wrench 10 allows for positioning the bolt head locking arm 38 closer to the side of the wrench body 12 thereby allowing the wrench 10 to be used in close and confined working conditions.

IN OPERATION

Referring now to FIGS. 1–4 and describing the operation of the subject adjustable socket wrench 10, the distance between the first and second sliding jaws 22 and 24 is increased for receiving different size bolt heads by threading the tightening nut 56 downwardly on the threads 54 on the lower end portion 18 of the wrench body 12. As this is done, the coil spring 70, which is in compression, urges the jaws 22 and 24 outwardly. The jaws 22 and 24 in turn pivot the first and second jaw guide arms 30 and 34 outwardly moving the first and second pivot arms 42 and 50 downwardly. As the first and second pivot arms 42 and 50 move downwardly, their lower ends 44 and 52 ride in the slide grooves 46. At this time the bolt head lock arm 38 is in an unlocked position as shown in FIG. 1.

When the distance between the first and second sliding jaws 22 and 24 is sufficient for receiving the bolt head 26, the bolt head 26 is inserted between the jaws as shown in FIG. 1*a*. The tightening nut is then threaded upwardly on the wrench body 12 which moves the first pivot arm 42 and the second pivot arm 50 upwardly. At this time the first jaw guide arm 30 and the second jaw guide arm 34 are pivoted upwardly with ends 32 and 36 moving inwardly sliding the first sliding jaw 22 and the second sliding jaw 24 toward each other and compressing the coil spring 70. The tightening nut 56 continues to be tightened until contact is made by the jaws 22 and 24 against the sides of the bolt head 26.

To insure zero tolerance between the sides of the bolt head 26 and the jaws 22 and 24, the bolt head locking arm 38, from an unlocked position, is pivoted inwardly as indicated by arrow 86 as shown in FIG. 1. Note in FIG. 1 a line A—A is disposed through the center of pins 74 and 76 used to attach the bolt head locking arm 38 to the first jaw guide arm 30 and the first pivot arm 42. When the bolt head locking arm 38 is moved to a locked position as shown in FIG. 1-*a*, the pin 76 moves upwardly and to the left of the line A—A or in this example "off center". At the same time, the pin 74 moves upwardly and to the right. As this occurs, the first jaw guide arm 30 is pivoted upwardly and the end 32 is moved to the left further tightening the first sliding jaw 22 against the bolt head 26 and creating a zero tolerance between the bolt head 26 and the jaws 22 and 24 to prevent any slippage when tightening and loosening the bolt 28. The ratchet lug 58 is then inserted into the bottom of the lower end portion 18 of the wrench body 12 and the ratchet handle 60 is ready for rotating the wrench 10 on the bolt 28 and shown in FIG. 1*a*. As mentioned above, the locking arm 38 can be released by hand or the release arm 88 can be used for moving the locking arm 38 into an unlocked position for releasing the wrench 10 from the bolt 28.

While not shown in the drawings, it should be mentioned that a lower portion of the face 66 of the jaws 22 and 24 is tapered downwardly and outwardly so that as the jaws 22 and 24 move toward each other and engage the sides of the bolt head 26 the taper of the face 66 allows for any slack adjustment in the jaws 22 and 24 and provides for complete engagement of the face 66 of the jaws 22 and 24 against the sides of the bolt head 26.

When the bolt 28 has been either tightened or removed from the work piece, the bolt head locking arm 38 is raised in an unlocked position as shown in FIG. 1 and the tightening nut is threaded downwardly moving the sliding jaws 22 and 24 away from the bolt head 26 thereby releasing the bolt 28 from the adjustable socket wrench 10.

While the invention has been particularly shown, described and illustrated in detail with reference to the preferred embodiments and modifications thereof, it should be understood by those skilled in the art equivalent changes in form and detail may be made therein without departing from the true spirit and scope of the invention as claim, except as precluded by the prior art.

The embodiments of the invention for which an exclusive privilege and property right is claimed are defined as follows:

1. An adjustable socket wrench for engaging, removing and replacing different size bolts in a work piece, the socket wrench is designed to engage a bolt head on a bolt at right angles, the socket wrench comprising;

a wrench body with an upper end portion, a middle portion and a lower end portion;

a channel cut across a width of the upper end portion of said wrench body for receiving a first sliding jaw and a second sliding jaw, the bolt head received between said first and second jaws;

guide means mounted on said wrench body for engaging and guiding said first and second sliding jaws inwardly and outwardly in said channel;

pivot means mounted on said wrench body for engaging said guide means and moving said guide means inwardly in said channel; and tightening means mounted on said wrench body and engaging said pivot means, said tightening means coacting with said pivot means and said guide means in tightening said first and second sliding jaws on the bolt head.

2. The socket wrench as described in claim 1 wherein said first and second sliding jaws have a "V" shaped face for engaging two sides each of the bolt head.

3. The socket wrench as described in claim 1 wherein said first and second sliding jaws have a face corresponding to the shape of jaw engaging sides each the bolt head.

4. The socket wrench as described in claim 1 further including spring biasing means mounted in said channel and engaging said first and second sliding jaws for urging said jaws outwardly and away from the bolt head when said tightening means is loosened on said wrench body.

5. The socket wrench as described in claim 1 further including bolt head locking means attached to said guide means and said pivot means for providing additional pivot force in urging said first and second sliding jaws against the bolt head and creating zero tolerance between the bolt head and said jaws.

6. An adjustable socket wrench for engaging, removing and replacing different size bolts in a work piece, the socket wrench is designed to engage a bolt head on a bolt at right angles, the socket wrench comprising;

a wrench body with an upper end portion, a middle portion and a lower end portion;

a channel cut across a width of the upper end portion of said wrench body for receiving a first sliding jaw and a second sliding jaw, the bolt head received between said first and second jaws;

a first jaw guide arm pivotally mounted on said wrench body and engaging said first sliding jaw, a second jaw guide arm pivotally mounted on said wrench body and engaging said second sliding jaw, said first and second jaw guide arms guiding said first and second sliding jaws inwardly and outwardly in said channel;

a first pivot arm pivotally mounted on said wrench body and attached to said first jaw guide arm, a second pivot arm pivotally mounted on said wrench body and attached to said second jaw guide arm, said first and second pivot arms moving said first and second jaw guide arms inwardly in said channel; and a tightening nut threaded on the lower portion of said wrench body and attached to said first and second pivot arms, when said tightening nut is tightened on said wrench body the tightening nut coacting with said pivot means and said guide means in tightening said first and second sliding jaws on the bolt head.

7. The socket wrench as described in claim 6 further including a bolt head locking arm attached to said first jaw guide arm and said first pivot arm for providing additional pivot force in urging said first and second sliding jaws against the bolt head and creating zero tolerance between the bolt head and said jaws.

8. The socket wrench as described in claim 6 further including coil spring mounted in said channel and engaging said first and second sliding saws for urging said jaws outwardly and away from the bolt head when said tightening nut is loosened on said wrench body.

9. The socket wrench as described in claim 6 further including an opening in the bottom of lower portion of said wrench body, said opening adapted for receiving one end of a ratchet handle, the ratchet handle used for turning the socket wrench for loosening and tightening the bolt on the work piece.

10. An adjustable socket wrench for engaging, removing and replacing different size bolts in a work piece, the socket wrench is designed to engage a bolt head on a bolt at right angles, the socket wrench comprising;

a wrench body with an upper end portion, a middle portion and a lower end portion;

a channel cut across a width of the upper end portion of said wrench body for receiving a first sliding jaw and a second sliding jaw, the bolt head received between said first and second jaws;

guide means mounted on said wrench body for engaging and guiding said first and second sliding jaws inwardly and outwardly in said channel;

pivot means mounted on said wrench body for engaging said guide means and moving said guide means inwardly in said channel;

bolt head locking means attached to said guide means and said pivot means for providing additional pivot force in urging said first and second sliding jaws against the bolt head and creating zero tolerance between the bolt head and said jaws; and tightening means mounted on said wrench body and engaging said pivot means, said tightening means coacting with said pivot means and said guide means in tightening said first and second sliding jaws on the bolt head.

11. The socket wrench as described in claim 10 further including means for releasing the bolt head locking means when the wrench is secured to the bolt head.

12. The socket wrench as described in claim 11 wherein the bolt head locking means is a bolt head locking arm and the means for releasing the bolt head locking means is a release arm attached to the bolt head locking arm.

13. The socket wrench as described in claim 12 wherein said release arm includes a cam surface for engaging a portion of the wrench body and for moving said locking arm from a locked position to an unlocked position on the wrench.

14. The socket wrench as described in claim 12 wherein said release arm includes means for remotely releasing said locking arm from a locked position.

15. The socket wrench as described in claim 10 wherein said first and second sliding jaws have a face corresponding to the shape of jaw engaging sides each the bolt head.

16. The socket wrench as described in claim 1 further including spring biasing means mounted in said channel and engaging said first and second sliding jaws for urging said jaws outwardly and away from the bolt head when said tightening means is loosened on said wrench body.

* * * * *